United States Patent [19]

Bailey

[11] 4,103,484

[45] Aug. 1, 1978

[54] TIME INDICATING DEVICE

[76] Inventor: James R. Bailey, 4020 N. Pioneer Ave., Chicago, Ill. 60634

[21] Appl. No.: 707,516

[22] Filed: Jul. 22, 1976

[51] Int. Cl.[2] ..... G04B 45/00; G04B 19/02

[52] U.S. Cl. ..... 58/125 C; 58/2

[58] Field of Search ..... 58/2, 5, 6 R, 6 A, 53–55, 58/125 C; 116/DIG. 14, 124.1 R, 124.1 A, 129 R, 129 E, 129 T, 135

[56] References Cited

U.S. PATENT DOCUMENTS

| | | | |
|---|---|---|---|
| 2,738,760 | 3/1956 | Myers | 116/135 |
| 3,125,985 | 3/1964 | Mallinger | 116/135 X |
| 3,298,172 | 1/1967 | Bodkins | 58/50 R |
| 3,443,749 | 5/1969 | Cimetta | 235/70 A |
| 3,587,222 | 6/1971 | Mestrovic | 58/2 |
| 3,620,004 | 11/1971 | Marz | 58/50 R |
| 3,645,087 | 2/1972 | Rams et al. | 58/6 A |
| 3,992,872 | 11/1976 | Stanish | 58/125 B |
| 4,022,015 | 5/1977 | Bailey | 58/125 C |

FOREIGN PATENT DOCUMENTS

| | | | |
|---|---|---|---|
| 498,957 | 7/1927 | Fed. Rep. of Germany | 58/125 C |

OTHER PUBLICATIONS

Webster's Seventh New Collegiate Dictionary G & C Merriam Co., 1965, Springfield, Mass., p. 443.

*Primary Examiner*—Edith S. Jackmon
*Attorney, Agent, or Firm*—Richard L. Johnston

[57] ABSTRACT

Time indicating devices are provided involving a unique arrangement of the structural parts including the housing and the time indicating mechanism, and also in a time indicating device having one or more endless belts carrying indicating means thereon, the provision of a unique structure involving guide members for the belts and the mounting of the time indicating mechanism including guide members on a single rigid base member which is readily removed and re-inserted into the housing.

2 Claims, 7 Drawing Figures

TIME INDICATING DEVICE

BACKGROUND

In my U.S. Pat. No. 3,956,879, a time indicating device has been described containing one or more endless indicating belts which carry indicating means thereon that define three or more equally spaced segments of said belts, the belts being mounted and driven by motive means such as a clock motor so that the indicating means thereon are visible through viewing areas in the face of the time indicating device in superposed relationship to the indicating means.

This type of time indicating device is unique but there is still room for improvement in the structuring of the device, particularly with regard to the assembly and accessibility of the various components.

OBJECTS

One of the objects of the present invention, therefore, is to provide a time indicating device of the type described which is restructured so that the housing and moving components are more readily assembled and more easily accessible.

Another object of the invention is to provide a time indicating device of the type described having one or more endless belts carrying indicating means thereon and means for accurately guiding the belts.

Still another object of the invention is to provide a time indicating device of the type described with guide members for guiding one or more endless belts which are structured to reduce friction, to prevent scratching, and build-up of static electricity.

Another object of the invention is to provide a time indicating device of the type described in which one or more endless belts carrying indicating means thereon, motive means for moving said belts and guide members for guiding said belts are all mounted on a single base member which can be readily assembled with a housing and, if desired, removed from said housing.

Other objects and advantages of the invention will be apparent from the following description in conjunction with the accompanying drawings.

THE DRAWINGS

Figures 4, 5, 6, 7:
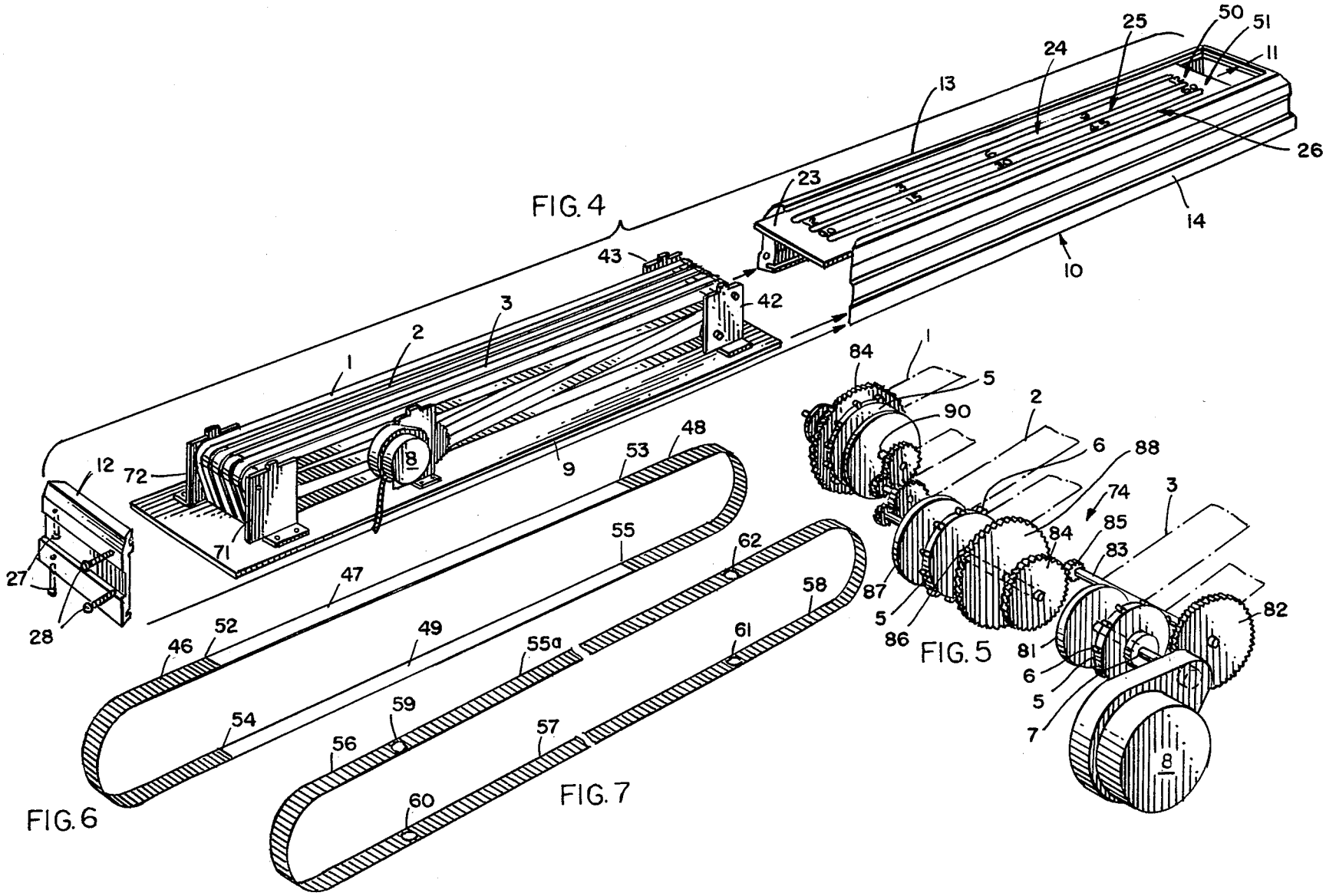
FIG. 4 is an exploded perspective view illustrating the manner in which the components of the device are assembled.
FIG. 5 is an exploded view in perspective of the elements of the driving mechanism embodied in the device shown in FIG. 2.

FIG. 6 is a perspective view of one type of endless belt which can be employed in a time indicating device of the type described herein wherein there are four segments with alternating segments having contrasting colors; and FIG. 7 is a perspective view of another type of endless belt that can be employed in a time indicating device in accordance with the invention in which the indicating means are dots, holes, or the like, painted on or perforated in the endless belt at equally spaced intervals to form segments, the dots, perforations or the like serving as indicating means.

BRIEF SUMMARY OF THE INVENTION

A time indicating device is provided with a housing having opposing side walls and opposing end walls, the insides of said walls having base guideways therein in a horizontal plane adjacent the lower parts of said walls, and top guideways therein in a horizontal place adjacent the upper parts of said walls, and at least one of said end walls being detachable so that a base member containing a time indicating mechanism can be slidably mounted in said base guideways and a face member containing one or more viewing areas through which time indicating elements of said time indicating mechanism are visible can be slidably mounted in the top guideways.

As a further feature the time indicating device has one or more endless belts carrying indicating means thereon, motive means for moving said belts, a face member containing one or more viewing areas through which said indicating means are visible and a rigid guide member for each of said belts adjacent said face member, the guide members having a base to receive the lower sides of said belts, a pair of opposing undercut sides to receive the opposing sides of each of said belts in the undercut portions of said sides with the top of said sides projecting inwardly and providing an opening above said belts through which said indicating means are visible. Optionally, as a preferred feature, the central portion of the top of each of said guide members is recessed to provide a space between the guide member and the under side of the belt being guided thereby to reduce friction, prevent scratching of visible areas, and build-up of static electricity. Another feature of the invention is the mounting of the belts, motive means and guide members on a single rigid base member.

DETAILED DESCRIPTION OF THE INVENTION

Figures 1, 2, 3:
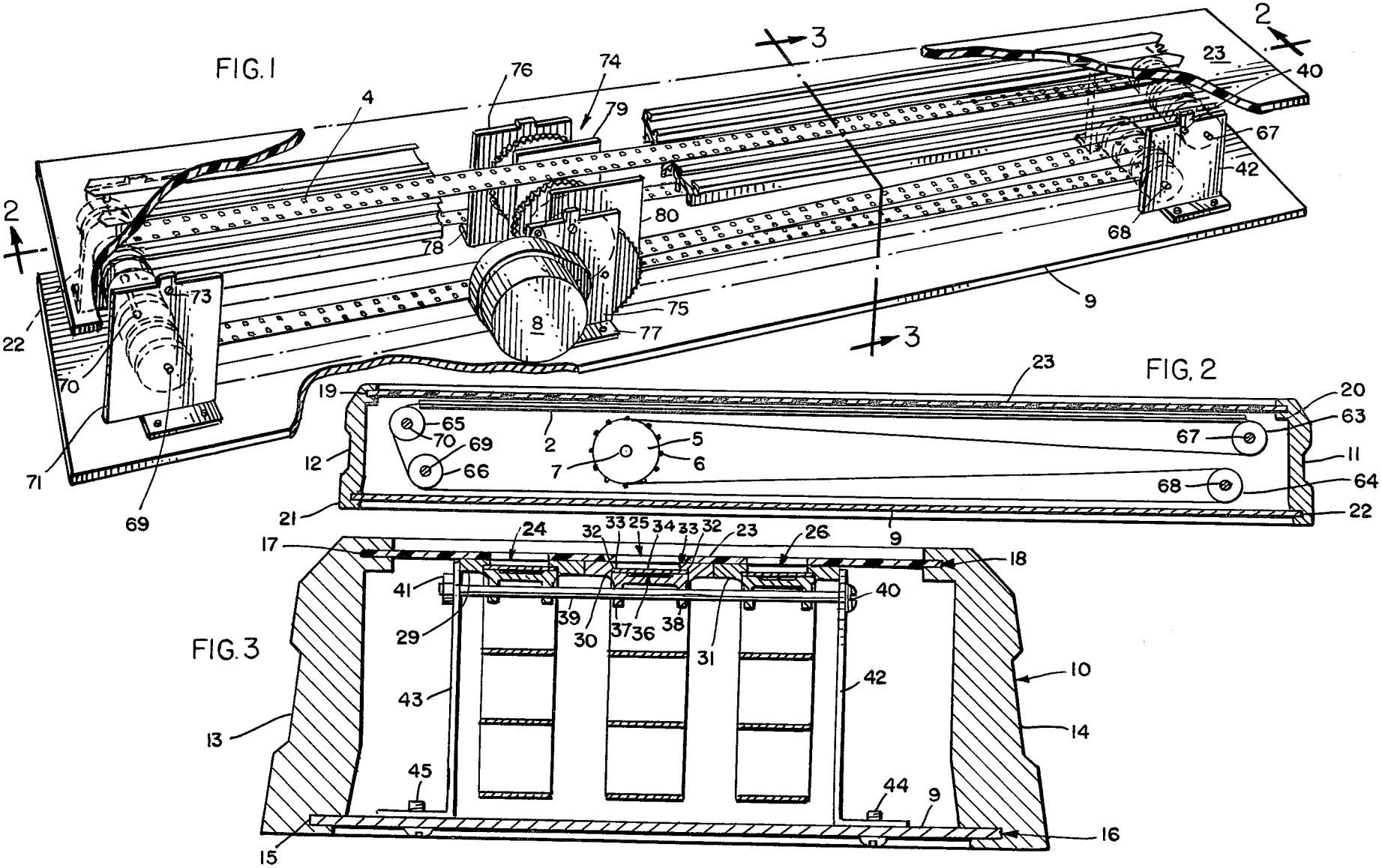
FIG. 1 is a perspective view of a time indicating device with parts broken away illustrating one embodiment of the invention.
FIG. 2 is a sectional view taken along the line 2,2 of FIG. 1.
FIG. 3 is a sectional view taken along line 3,3 of FIG. 1.

In the embodiment of the invention illustrated in FIGS. 1 and 4, the time indicating device is a clock containing three endless belts 1, 2 and 3 only one of which is shown completely in FIG. 1. Each of the endless belts contains sprocket holes 4 and each is driven by means of a sprocket wheel 5 containing teeth 6 which engage the sprocket holes 4. The sprocket wheel 5 is mounted on a shaft 7 and is connected by means of a gear train as shown in FIG. 5 to a constant speed clock motor 8 which drives the belts at different speeds so as to register hours, minutes and seconds on the face of the clock.

The endless belts and the motive means together with the gear train connecting the endless belts to the motive means, as well as a series of rollers for the endless belts are all mounted on a base member 9 which is adapted to be inserted into a housing 10. The housing 10 has opposing ends 11 and 12 and opposing sides 13 and 14. The opposing sides contain recesses or guideways 15 and 16 as shown in FIG. 3 which are in a horizontal plane adjacent the lower parts of the side walls, herein referred to as base guideways. The opposing side walls also contain recesses or guideways 17 and 18 which are adjacent the upper parts of the side walls and are herein referred to as top guideways. The ends 11 and 12 contain recesses or guidways 19 and 20 in the upper parts thereof which are also top guideways, and recesses or guideways 21 and 22 in the lower parts thereof which are base guideways.

As illustrated in FIG. 4 a face member 23 having openings or transparent viewing areas 24, 25 and 26 is slidably mounted in the top guideways 17 and 18 so that one end thereof also enters the top guideway of end member 11.

The base member 9 is also slidably mounted in the recesses 15 and 16 of housing 10 with one end thereof disposed in recess 22 of end member 11. End member 12 is then applied to the housing so that face member 23 enters recess 19 and base member 9 enters recess 21. End member 12 is detachably secured to the housing 10 by means of screws 27 and 28.

As shown in FIG. 3, each of the endless belts on the underside of face member 23 is supported by guide members 29, 30 and 31. Each of the guide members has undercut portions 32,32 in opposing sides to receive the opposing sides of each of said belts with the tops 33,33 of the sides of the guide members projecting inwardly and providing an opening 34 above said belts through which said indicating means are visible due to the fact that the viewing areas 24,25 and 26 of face member 23 are transparent or are in the form of a slot or opening. Each of the guide members 29, 30 and 31 has a recessed area 36 beneath the belt which it supports providing a space between the guide member and the underside of the belt being guided thereby to reduce friction, avoid scratching, and buildup of static electricity. Each of the guide members 29, 30 and 31 also has dependent elements 37 and 38 on opposite sides thereof which have holes therein to receive a shaft 39.

In the embodiment illustrated the shaft 39 is in the form of a bolt having a head 40 and secured by a nut 41 to L-shaped supporting members 42 and 43 which in turn are secured to base member 9 by screws 44 and 45.

The guide members 29, 30 and 31 are extruded or molded and can be made from metal or plastic. They can also be colored. Endless belts 1, 2 and 3 are preferably made of plastic material of the type used in making photographic movie film and preferably have transparent or translucent segments so that the color of the guide members 29, 30 and 31 will appear through the viewing areas of face member 23.

The endless belts can have four equally spaced segments, intersecting end to end 46, 47, 48 and 49 as shown in FIG. 6 with the segments 46 and 48 being of contrasting colors with respect to segments 47 and 49.

The mating points of these segments constitute means for indicating time. Thus, at point 52 where opaque section 46 joins clear section 47 is where time is indicated. Time indicating means 50 and 51 are applied in the form of numerals or other types of indicia to the top of face member 23 adjacent the viewing areas 24, 25 and 26 in order to determine the time. In the particular embodiment shown, the belt 1 in the form illustrated in FIG. 6 would move from point 52 to point 53 in a period of 12 hours. Belt 2 in the form illustrated in FIG. 6 would move from point 52 to point 53 in a period of one hour, or 60 minutes. Belt 3 in the form illustrated in FIG. 6 would move from point 52 to point 53 in 60 seconds or 1 minute.

The distance between the points 52 and 53 on each of the endless belts is equal to the distance between the ends of the viewing areas 35. Thus, when the guide members 29, 30 and 31 are colored and the segments 46 and 48 are opaque and 47 and 49 are transparent the color of members 29, 30 and 31 will appear through the transparent section and the clock reading is similar to that of a bulb type thermometer. When the points 52 and 53 of belt 1 are opposite the numerals 12 on the scale 50 of face member 23 and the points 52 and 53 of belt 2 are opposite the numerals 0 and 60 of scale 51 on face member 23, the time reading will be either noon or midnight. As the point 52 moves toward the point originally occupied by the point 53, the time will be indicated in hours by belt 1, in minutes by belt 2 and in seconds by belt 3. When the point 52 on each belt reaches the point originally occupied by point 53, the point 54 will be in the position originally occupied by point 52 and the point 55 will be in the position originally occupied by the point 54. Hence, the time in hours, minutes and seconds will be shown by segment 46.

In the embodiment shown in FIG. 7 the boundary line between segments 55*a*, 56, 57 and 58 is marked by dots 59, 60, 61 and 62 which can be in the form of perforations in the belts or they can be painted on the belts. If they are in the form of holes or perforations and the remaining areas 55A, 56, 57 and 58 are opaque and the guide members 29, 30 and 31 are colored, the color of the guide members will show through the holes 59, 60, 61 and 62 and the movement of the holes 59, 60, 61 and 62 will indicate the time in hours, minutes and seconds as previously explained.

The endless belts are carried on rollers 63, 64, 65 and 66 mounted on shafts 67, 68, 69 and 70. The shafts 67 and 68 are mounted in brackets 42 and 43 and the shafts 69 and 70 are mounted in brackets 71 and 72. A bolt 73 in brackets 71 and 72 serves the same purpose as the bolt 40 in brackets 42 and 43 for supporting the other ends of guide members 29, 30 and 31.

The motive means generally indicated at 74 consisting of the constant speed motor 8 and the gear train generally illustrated in FIG. 5 is supported by brackets 75 and 76 which are secured to base member 9 at points 77 and 78 by means of screws or other suitable means. Additional brackets 79 and 80 which are also secured or affixed to base member 9 are provided to support intermediate shafts in the gear train. Thus, the entire motive means, together with the guide members 29, 30 and 31 are all supported by base member 9 which can be inserted as a unit into the housing 10 and if desired, easily removed therefrom.

In the gear train shown in FIG. 5 the constant speed motor 8 drives the seconds belt 3 directly through sprocket wheel 5 containing teeth 6 on shaft 7. Wheel 81 which is affixed to shaft 7 also supports endless belt 3. A pinion on shaft 7 drives gear 82 which is affixed to shaft 83 and drives gear 84 through pinion 85. Gear 84 is affixed to shaft 86 which drives sprocket wheel 5 through a slip clutch, not shown. Sprocket wheel 5 drives belt 2 through teeth 6. Belt 2 is also supported by wheel 87. Adjusting wheel 88 mounted on shaft 86 can be used to set the position of belt 2 in order to regulate the time. Due to the slip clutch, adjusting wheel 88 makes it possible to move sprocket wheel 5 and belt 2 without moving shaft 86. Thus, the position of the minute belt can be changed in order to correct the time.

Similarly, adjusting wheel 89 is provided in order to make it possible to move the hour belt 1, due to the fact that it is fixed to sprocket wheel 5 and the latter is driven from shaft 90 through a slip clutch, not shown. A suitable type of slip clutch is disclosed in my U.S. Pat. No. 3,956,879. The use of the slip clutch per se does not constitute a part of the present invention.

The time indicating devices provided in accordance with the invention have numerous modifications and variations as illustrated in the aforementioned patent. Clocks made in accordance with the invention can have merely a single belt or two, three, four or more belts to indicate time of the day, as well as days of the week and months.

It is thought that the invention and its numerous attendant advantages will be fully understood from the foregoing description, and it is obvious that numerous changes may be made in the form, construction and arrangement of the several parts with departing from the spirit or scope of the invention, or sacrificing any of its attendant advantages, the form herein disclosed being a preferred embodiment for the purpose of illustrating the invention.

The invention is hereby claimed as follows:

1. A time indicating device comprising one or more endless belts divided into segments of contrasting appearance which meet one another successively end to end, motive means for moving said belts, a face member containing one or more viewing areas through which said segments of said belts are visible, and a rigid elongated guide member for each of said belts adjacent said face member, said guide members having a base to receive the lower sides of said belts, a pair of opposing undercut sides to receive the opposing sides of each of said belts in the undercut portion of said sides with the tops of said sides projecting inwardly and providing an opening above said belts through which said segments are visible, the base of said guide members over which said belts pass being colored and said belts being divided into equal segments which are alternately transparent and opaque, each segment having a length corresponding to the length of the viewing areas in the face member so that the color of said guide members is transmitted through said transparent segments and is visible in its respective viewing area.

2. A device as claimed in claim 1 in which the meeting points of said segments are marked by holes in said belts through which the color of said guide members is visible in the respective viewing area.

* * * * *